US010538989B2

(12) United States Patent
Merron

(10) Patent No.: US 10,538,989 B2
(45) Date of Patent: Jan. 21, 2020

(54) EXPANDABLE SEAL

(71) Applicant: Halliburton Energy Services, Inc., Houston, TX (US)

(72) Inventor: Matthew J. Merron, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 92 days.

(21) Appl. No.: 15/564,638

(22) PCT Filed: May 18, 2015

(86) PCT No.: PCT/US2015/031402
§ 371 (c)(1),
(2) Date: Oct. 5, 2017

(87) PCT Pub. No.: WO2016/186643
PCT Pub. Date: Nov. 24, 2016

(65) Prior Publication Data

US 2018/0073323 A1 Mar. 15, 2018

(51) Int. Cl.
*E21B 33/128* (2006.01)
*E21B 33/12* (2006.01)
(Continued)

(52) U.S. Cl.
CPC ..... *E21B 33/128* (2013.01); *E21B 33/1212* (2013.01); *E21B 33/1277* (2013.01); *E21B 2033/005* (2013.01)

(58) Field of Classification Search
CPC ..... E21B 33/1208; E21B 33/128; E21B 2033/005; E21B 33/1212; F16J 15/028; F16J 15/0887
See application file for complete search history.

(56) References Cited

U.S. PATENT DOCUMENTS 4,444,403 A * 4/1984 Morris ..... F16J 15/3284 138/110
4,482,086 A * 11/1984 Wagner ..... E21B 33/1208 166/118
(Continued)

FOREIGN PATENT DOCUMENTS

GB 2357098 A 6/2001
GB 2426022 A 11/2006
(Continued)

OTHER PUBLICATIONS

Intellectual Property Office of Singapore, Application No. 11201708385U, Search Report and Written Opinion, dated Nov. 21, 2018, 9 pages Singapore.
(Continued)

*Primary Examiner* — Kipp C Wallace

(57) ABSTRACT

A high-pressure capable sealing apparatus and method for sealing against an interior surface of a cylindrical tubular member provides the ability to expand to a larger diameter from a given running diameter and to transition back to the original diameter. The sealing apparatus may include a ring assembly with a metallic ring characterized by a uniform axial cross-sectional profile having an outward-facing convexity and an inward-facing concavity. A plurality of slits may be radially formed through the ring about the outer surface to relieve stress within the ring during radial expansion. A circular resilient gasket may be at least partially coaxially disposed within the ring concavity. The ring assembly may be located between uphole and downhole shoulders, which may be selectively axially movable with respect to one another so as to selectively axially compress and radially expand the ring into sealing engagement with a tubular member.

19 Claims, 7 Drawing Sheets

(51) Int. Cl.
*E21B 33/127* (2006.01)
*E21B 33/00* (2006.01)

(56) References Cited

U.S. PATENT DOCUMENTS

| | | | | |
|---|---|---|---|---|
| 4,448,740 | A | 12/1984 | Baugh et al. | |
| 5,180,008 | A * | 1/1993 | Aldridge | E21B 33/03 166/84.1 |
| 5,226,492 | A * | 7/1993 | Solaeche | E21B 33/128 166/196 |
| 5,775,429 | A | 7/1998 | Arizmendi et al. | |
| 5,819,846 | A | 10/1998 | Bolt, Jr. | |
| 5,904,354 | A * | 5/1999 | Collins | F16J 15/028 166/187 |
| 6,640,893 | B1 * | 11/2003 | Rummel | E21B 33/1208 166/187 |
| 7,497,443 | B1 * | 3/2009 | Steinetz | F16J 15/0887 277/644 |
| 8,113,276 | B2 | 2/2012 | Greenlee et al. | |
| 8,191,625 | B2 | 6/2012 | Porter et al. | |
| 8,336,635 | B2 | 12/2012 | Greenlee et al. | |
| 8,469,087 | B2 | 6/2013 | Gray | |
| 8,695,695 | B2 | 4/2014 | Moeller et al. | |
| 8,967,301 | B2 * | 3/2015 | Curry | E21B 10/25 175/371 |
| 9,145,755 | B2 * | 9/2015 | Farquhar | E21B 33/1216 |
| 2004/0031605 | A1 | 2/2004 | Mickey | |
| 2005/0217869 | A1 * | 10/2005 | Doane | E21B 23/06 166/387 |
| 2005/0263296 | A1 | 12/2005 | Moyes | |
| 2006/0260820 | A1 | 11/2006 | Whitsitt et al. | |
| 2009/0242211 | A1 | 10/2009 | Fagley, IV et al. | |
| 2010/0019426 | A1 | 1/2010 | Kunz | |
| 2010/0148446 | A1 * | 6/2010 | Gaudette | E21B 33/10 277/307 |
| 2010/0200218 | A1 | 8/2010 | Palidwar et al. | |
| 2010/0206571 | A1 | 8/2010 | Tunc et al. | |
| 2010/0276137 | A1 | 11/2010 | Nutley et al. | |
| 2011/0193291 | A1 * | 8/2011 | Schilte | E21B 33/1208 277/314 |
| 2013/0087334 | A1 | 4/2013 | Buytaert et al. | |
| 2013/0147121 | A1 | 6/2013 | Xu | |
| 2014/0202708 | A1 | 7/2014 | Jacob et al. | |
| 2016/0208577 | A1 * | 7/2016 | Byberg | E21B 34/14 |

FOREIGN PATENT DOCUMENTS

| | | | |
|---|---|---|---|
| GB | 2472287 | A | 2/2011 |
| GB | 2474599 | A | 4/2011 |
| WO | WO 2007/131134 | A2 | 11/2007 |

OTHER PUBLICATIONS

Office Action and Search Report issued for Danish Patent Application No. PA201770779 dated May 9, 2018, 8, pages.

International Search Report and the Written Opinion of the International Search Authority, or the Declaration, dated Feb. 4, 2016, PCT/US2015/031402, 15 pages, ISA/KR.

* cited by examiner

EXPANDABLE SEAL

PRIORITY

The present application is a U.S. National Stage patent application of International Patent Application No. PCT/US2015/031402, filed on May 18, 2015, the benefit of which is claimed and the disclosure of which is incorporated herein by reference in its entirety.

TECHNICAL FIELD

The present disclosure relates generally to operations performed and equipment used in conjunction with a subterranean well, such as a well for recovery of oil, gas, or minerals. More particularly, the disclosure relates to reusable expandable seals for downhole applications.

BACKGROUND

In the course of drilling, completing, or servicing a subterranean well for hydrocarbon production, one or more seals, or packers, may be installed in the wellbore to isolate one zone from another. A seal may be run into a wellbore via wireline, slick line, coiled tubing, drill string, or another conveyance, and then radially expanded into sealing engagement with the interior surface of a casing, liner, or other tubular member.

Expandable seals must be able to operate against increasingly higher pressures and axial forces. Differential pressures across a seal may reach up to 15,000 psi.

Resilient materials such as rubber, which can readily be axially compressed to cause their diameters to expand, tend to have very low pressure holding capabilities due to the tendency of the resilient material to axially extrude into an extrusion gap under a differential pressure. These types of sealing mechanisms usually require structural extrusion limiters to reduce the extrusion gap. Moreover, resusable resilient seals may become subject to damaged sealing surfaces, referred to as nibbling, in which small edge portions of the sealing element become detached over repeated uses.

Recently, dissolving frac plugs have been commercialized. Currently dissolving elastomeric elements used on dissolving frac plugs tend to dissolve too slowly at temperatures below 200 F. Metallic dissolving materials dissolve more quickly below 200 F. In dissolving frac plug applications, the use of metallic seal made from the dissolving metal alloys may improve full dissolution of the frac plug below 200 F. The dissolving metallic alloys also dissolve into solution and do not reform at cooler temperatures. Currently dissolving rubber or rubber-like elements do not completely dissolve into solution; rather they flake apart into particles and chunks. Certain types may also break down to consistency of low torque grease or syrup, and in some cases these types of materials can reform as solids at the cooler temperatures that occur near the surface of the wellbore. Particles, chunks, low torque grease, syrup, or reformed solid chunks flowing through wellhead or surface equipment may create restrictions and clogs. The dissolving metallic alloys reduce this risk, because they dissolve more fully into solution.

A metallic circular seal may also be radially expanded to form a seal, which may be operable under a higher differential pressure than a resilient member and less prone to nibbling effects. However, the expansion process to a larger diameter introduces internal stresses in the sealing element. The outer diameter fibers of the seal will require a growth in length, which creates geometry and stress challenges when using metallic materials. Such stresses may cause a metallic seal to become plastically deformed and therefore not able to retract when desired. Accordingly, when designing a seal, materials and/or geometries that allow high expansion with acceptable stresses tend to sacrifice the strength and pressure holding capabilities.

For many oil and gas applications, a perfect seal is not required. A metallic circular seal that is radially expanded may prevent majority of flow and meet the application needs. In many applications, the fluid media itself may bridge seal imperfections, and in doing so, provide a full seal. For example, many hydraulic fracturing applications include sand in the fluid media. Sand and gel-like fluids used in the hydraulic fracturing media are known to bridge and block seal imperfections.

BRIEF DESCRIPTION OF THE DRAWINGS

Embodiments are described in detail hereinafter with reference to the accompanying figures, in which.

DETAILED DESCRIPTION

Figure 1:
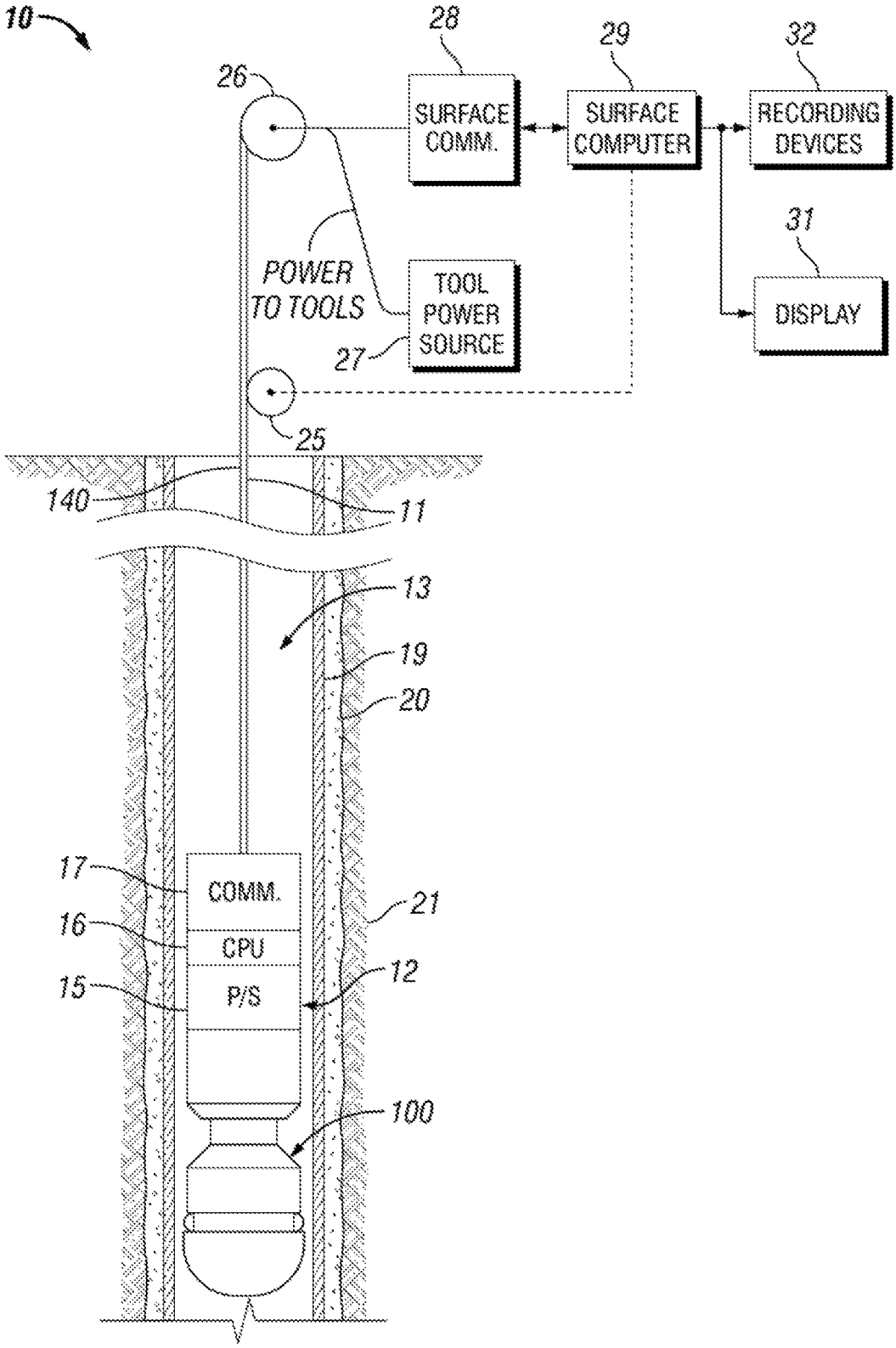
FIG. 1 is a block-level schematic diagram of an exemplary wireline system, showing a wireline tool suspended by wireline with an apparatus for sealing against an interior surface of a cylindrical tubular member, according to an embodiment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above,"

"upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 shows a system view of a wireline system 10 according to one or more embodiments. A conveyance 140, such as wireline cable 11, suspends a wireline tool 12 in a wellbore 13. Wellbore 13 may be lined with casing 19 and a cement sheath 20, or wellbore 13 may be open hole (not illustrated). Wellbore 13 can be any depth, and the length of wireline cable 11 should be sufficient for the depth of wellbore 13. Wireline system 10 may include a sheave 25 which may be used in guiding the wireline cable 11 into wellbore 13. Wireline cable 11 may be spooled on a cable reel 26 or drum for storage. Wireline cable 11 may be structurally connected with wireline tool 12 and payed out or taken in to raise and lower wireline tool 12 in wellbore 13.

Wireline tool 12 may have a protective shell or housing which may be fluid tight and pressure resistant to enable the equipment within the interior to be supported and protected during deployment. Wireline tool 12 may enclose one or more sealing tools 100, as described hereinafter. However, other types of tools, including logging tools, fishing tools, perforating tools, coring tools, and testing tools may be also used.

Wireline tool 12 may also enclose a power supply 15 and a computer or processor system 16. Output data streams of one or more detectors may be provided to a communications module 17 having an uplink communication device, a downlink communication device, a data transmitter, and a data receiver, for example.

One or more electrical wires in wireline cable 11 may be connected with surface-located equipment, which may include a power source 27 to provide power to tool power supply 15, a surface communication module 28 having an uplink communication device, a downlink communication device, a data transmitter and also a data receiver, a surface computer 29, a display 31, and one or more recording devices 32. Sheave 25 may be connected by a suitable sensor to an input of surface computer 29 to provide depth measuring information.

Figure 2:
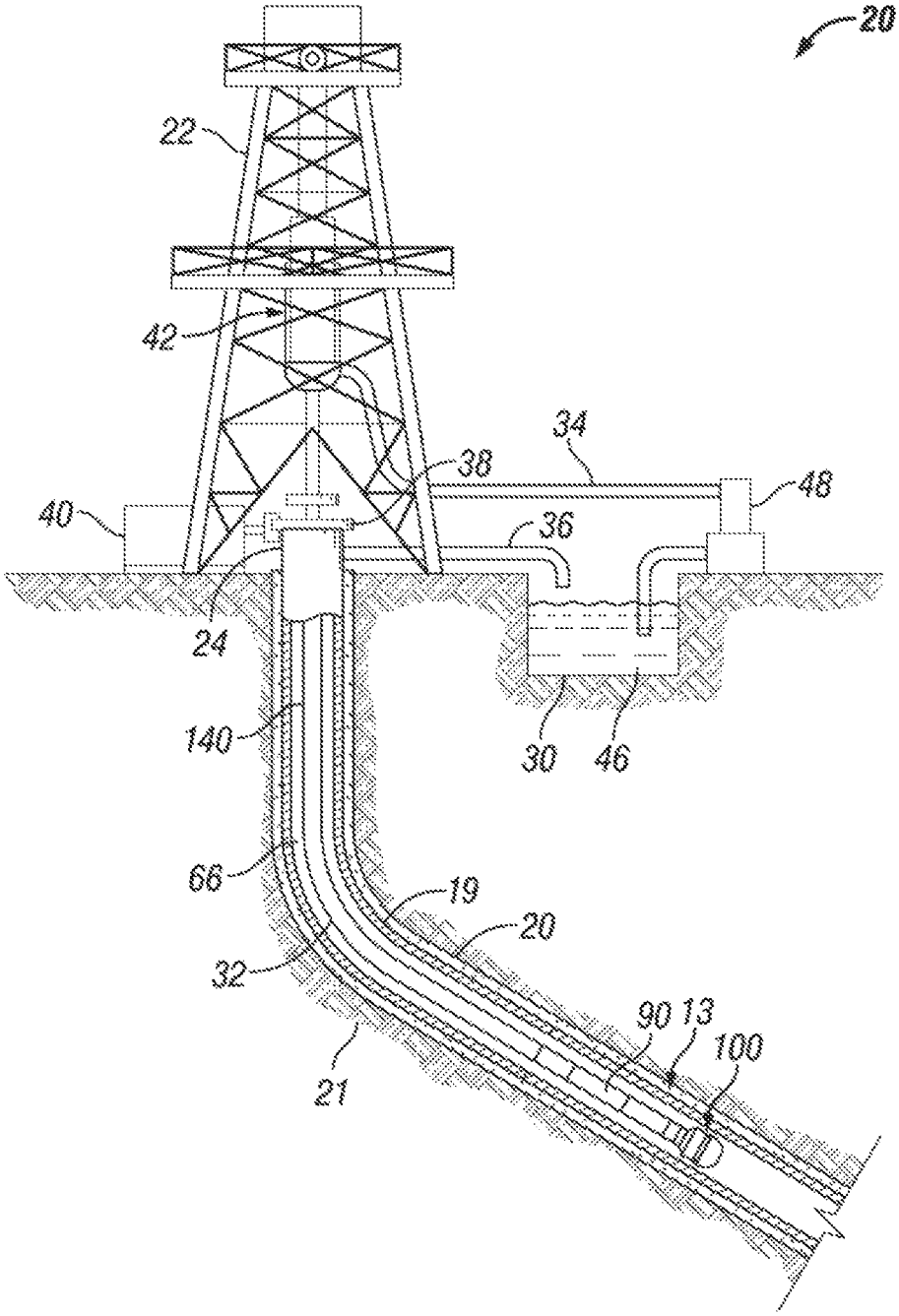
FIG. 2 is an elevation view in partial cross section of an exemplary drilling, completion, workover system or the like, showing a rig carrying a string and a downhole tool with an apparatus for sealing against an interior surface of a cylindrical tubular member, according to an embodiment.

FIG. 2 illustrates a system view of a drilling, completion, workover system 20 or the like according to one or more embodiments. System 20 may include a derrick or rig 22, which may be located on land, as illustrated, or atop an offshore platform, semi-submersible, drill ship, or any other suitable platform. Rig 22 may carry a conveyance 140, which may be a drill string 32 or the like. Rig 22 may be located proximate well head 24. Rig 22 may also include rotary table 38, rotary drive motor 40 and other equipment associated with rotation of drill string 32 within wellbore 13. For some applications rig 22 may include top drive motor or top drive unit 42. Blow out preventers (not expressly shown) and other equipment associated with drilling a wellbore 13 may also be provided at well head 24.

One or more pumps 48 may be used to pump drilling fluid 46 from fluid reservoir or pit 30 via conduit 34 to the uphole end of drill string 32 extending from well head 24. Annulus 66 is formed between the exterior of drill string 32 and the inside diameter of wellbore 13. The downhole end of drill string 32 may carry one or more downhole tools 90, which may include one or more sealing tools 100, as described hereinafter. Further, a bottom hole assembly, mud motor, drill bit, perforating gun, fishing tool, sampler, sub, stabilizer, drill collar, tractor, telemetry device, logging device, or any other suitable tool(s) (not expressly illustrated) may be carried by drill string 32. Drilling fluid 46 may flow through a longitudinal bore (not expressly shown) of drill string 32 and exit into wellbore annulus 66 via one or more ports. Conduit 36 may be used to return drilling fluid, reservoir fluids, formation cuttings and/or downhole debris from wellbore annulus 66 to fluid reservoir or pit 30. Various types of screens, filters and/or centrifuges (not expressly shown) may be provided to remove formation cuttings and other downhole debris prior to returning drilling fluid to pit 30.

Figure 3A:
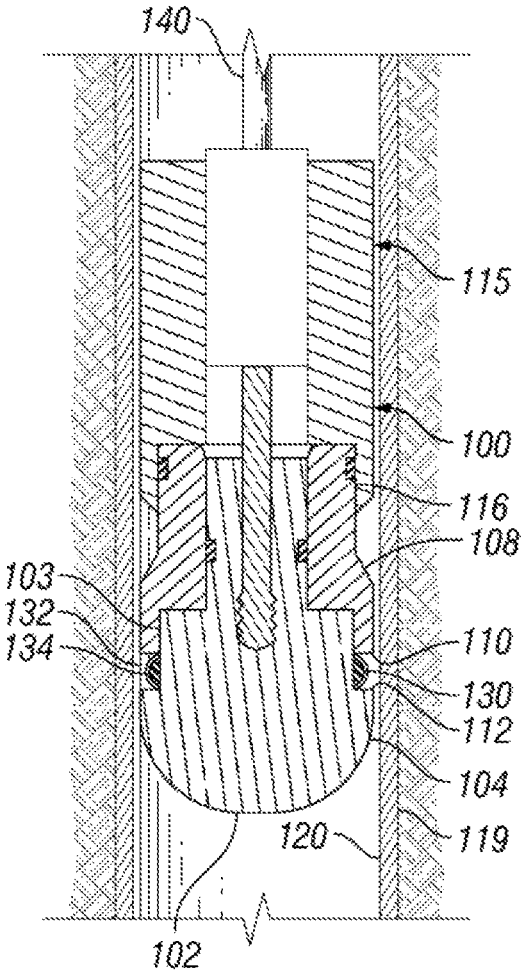
FIG. 3A is an axial cross section of a sealing apparatus according to an embodiment shown in a non-sealing configuration.
Figure 3B:
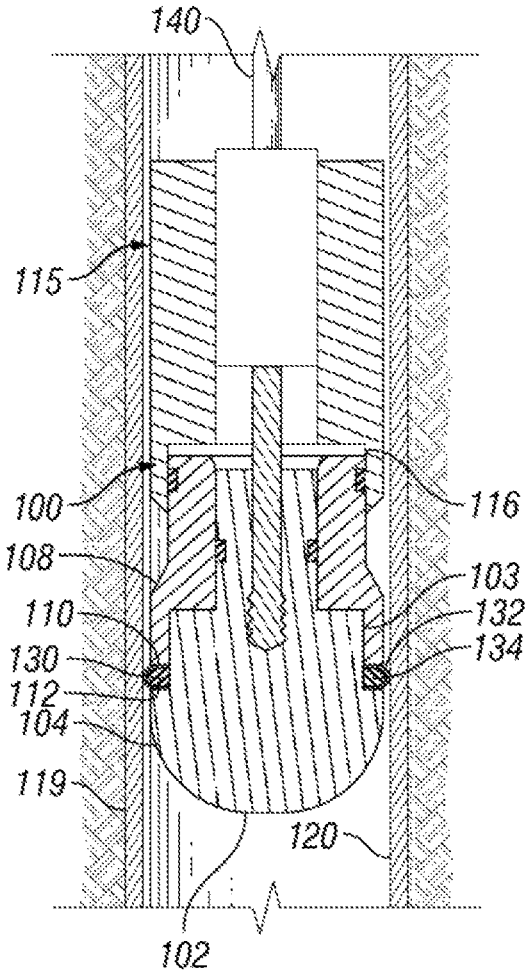
FIG. 3B is an axial cross section of a sealing apparatus of FIG. 3A shown in sealing engagement within a cylindrical tubular member.
Figure 4A:
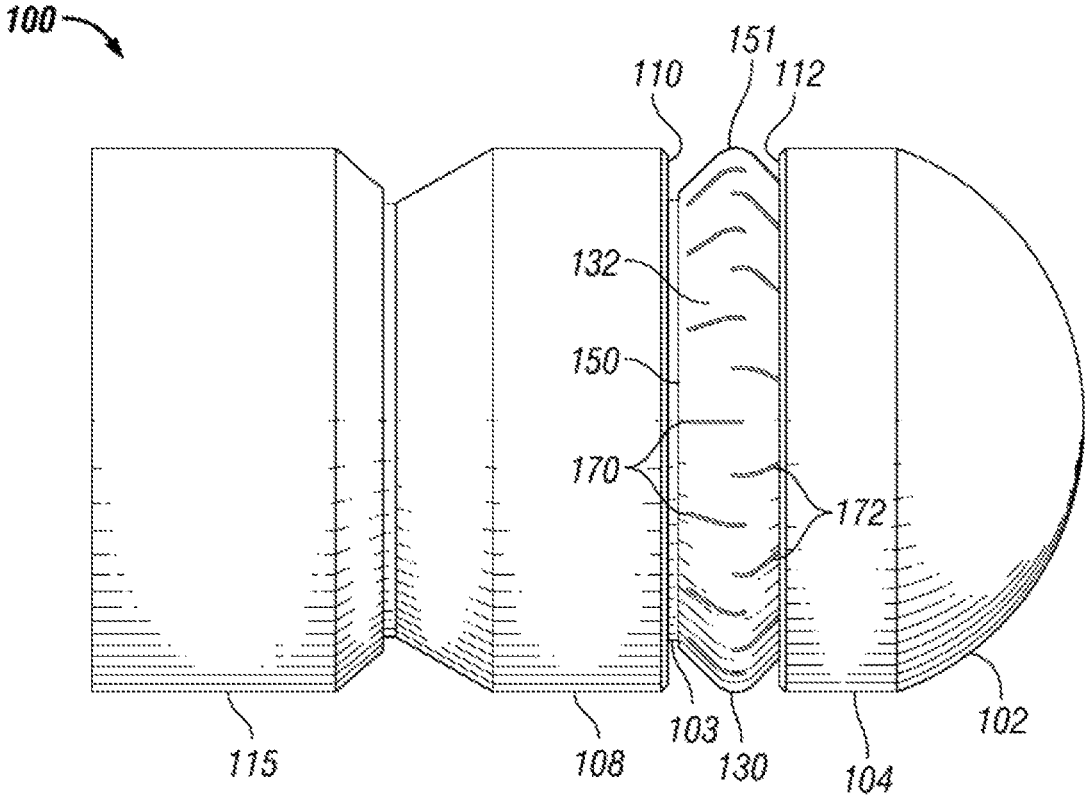
FIG. 4A is an elevation view of the sealing apparatus of FIG. 3A shown in a non-sealing configuration.
Figure 4B:
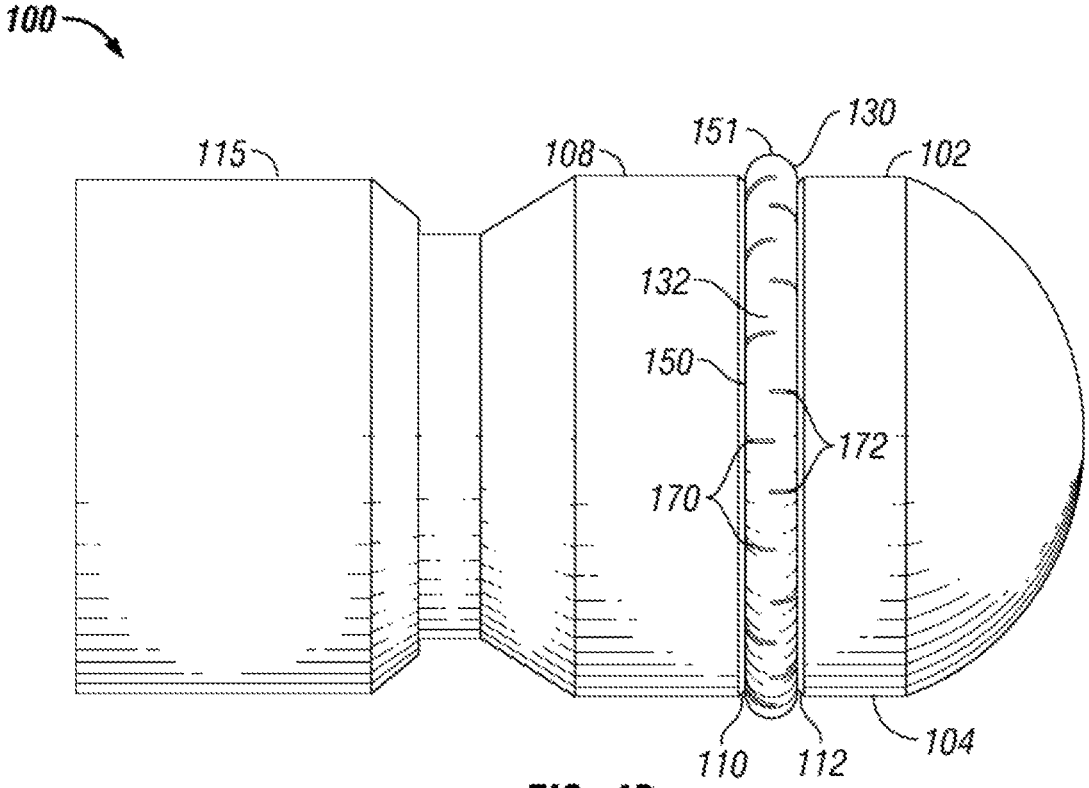
FIG. 4B is an elevation view of the sealing apparatus of FIG. 3A shown in a sealing configuration.

FIGS. 3A and 3B are simplified axial cross sections of a sealing apparatus 100 according to an embodiment. Sealing apparatus 100 is shown disposed within a cylindrical tubular member 119, which may be casing 19 (FIGS. 1 and 2), a liner, or other tubular member. In FIG. 3A, sealing apparatus 100 is shown in a non-sealing configuration with a radially-expandable ring assembly 130 disengaged from an interior surface 120 of tubular member 119. In FIG. 3B, sealing apparatus 100 is shown in a sealing configuration with ring assembly 130 in a radially expanded state and in sealing engagement with interior surface 120 of tubular member 119. FIGS. 4A and 4B are elevation views of sealing apparatus 100 of FIGS. 3A and 3B, respectively.

Referring to FIGS. 3A-4B, ring assembly 130 may be axially captured between an uphole shoulder 110 and a downhole shoulder 112. Uphole shoulder 110 may be axially movable with respect to downhole shoulder 112. In FIG. 3A, the distance between uphole shoulder 110 and downhole shoulder 112 is sufficient for ring assembly 132 exist in a relaxed, uncompressed state, with uphole and downhole ends of ring assembly 130 may just abut uphole shoulder 110 and downhole shoulder 112, respectively. In FIG. 3B, uphole shoulder 110 is moved axially closer to downhole shoulder 112, thereby axially compressing ring assembly 130 and forcing ring assembly 130 to expand radially into sealing engagement with inner surface 120 of tubular member 119.

In one or more embodiments, ring assembly 130 is coaxially carried about a base 102. Base 102 may have a region 103 of a reduced outer diameter that is slightly smaller than the inner diameter ring assembly 130. Base 102 may also include a region 104 of greater outer diameter. The intersection of regions 103 and 104 may either define uphole shoulder 110 or downhole shoulder 112. A sleeve 108 may also be coaxially carried about a portion of base 102. Sleeve 108 is arranged to be axially movable with respect to base 102. Sleeve 108 may either define uphole shoulder 110 or downhole shoulder 112, whichever is not defined by base 102. In FIGS. 3A and 3B, base 102 is shown as forming downhole shoulder 112, and sleeve 108 is shown as forming uphole shoulder 110. However, the opposite arrangement may be equally suitable.

An actuator assembly 115 may be provided to axially move sleeve 108 with respect to base 102, thereby selectively controlling the distance between uphole shoulder 110 and downhole shoulder 112. In one or more embodiments, sleeve 108 may act as a piston that slides within a cylinder 116 formed within actuator assembly 115. A volume of hydraulic fluid within cylinder 116 may be selectively controlled by actuator assembly 115 to move sleeve 108 and thereby axially compress ring assembly 130. Though a hydraulic actuator assembly 115 is illustrated and described herein, a routineer may recognize that any suitable actuator assembly may be used, including lead screw actuators, rack and pinion actuators, solenoids, and the like. Moreover, sleeve 108 may remain stationary with respect to actuator assembly 115, and actuator assembly 115 may be operable to move base 102 with respect to sleeve 108.

Figure 5:
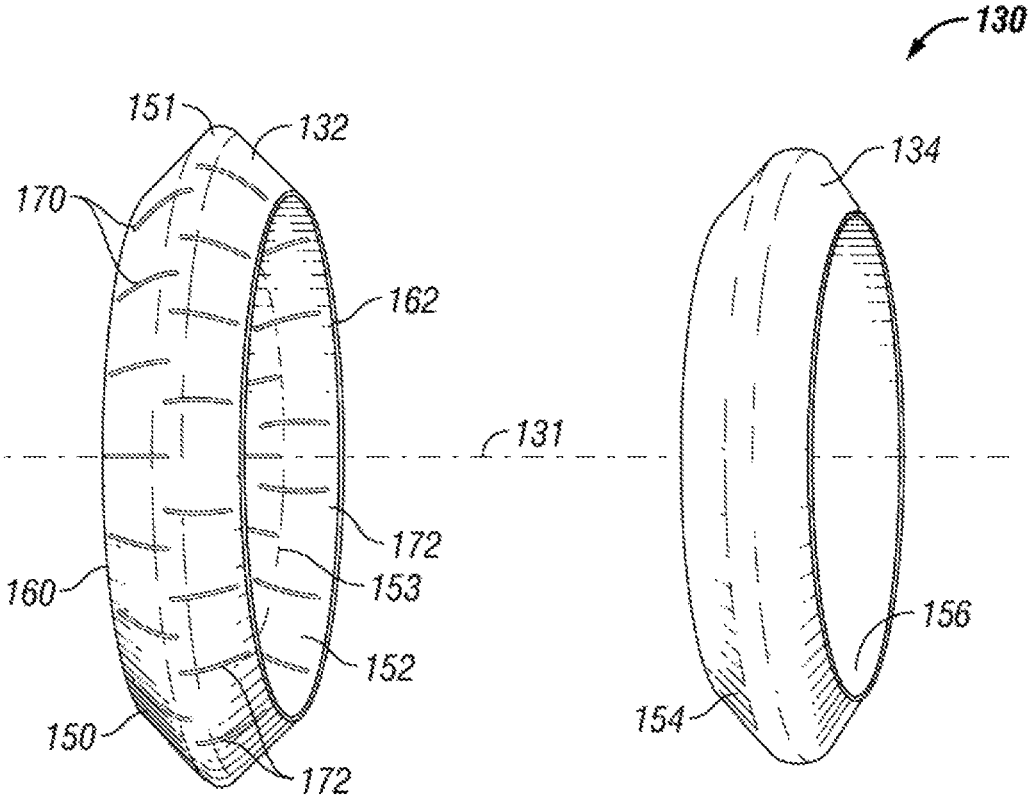
FIG. 5 is an exploded perspective view of a sealing ring assembly according to an embodiment suitable for use in the sealing apparatus of FIG. 3A.
Figure 6:
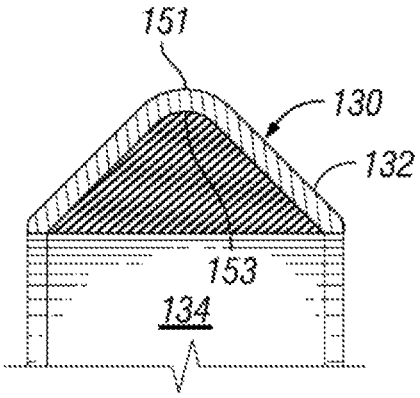
FIG. 6 is an axial cross section of a portion of the sealing ring assembly of FIG. 5, shown in a non-sealing state.
Figure 7:
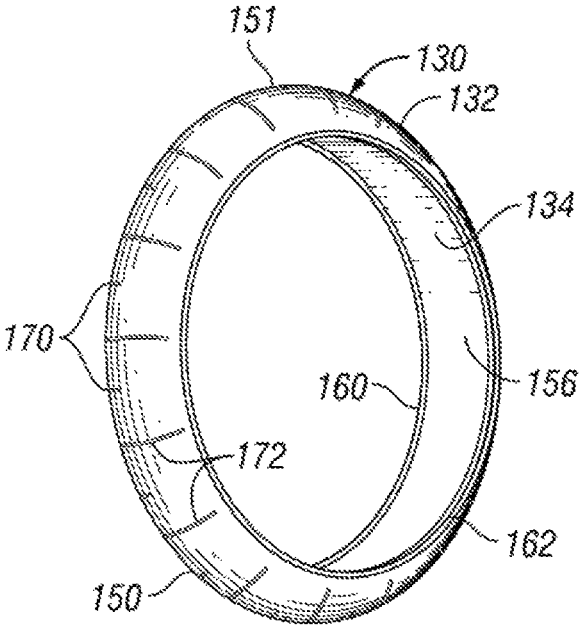
FIG. 7 is a perspective view of the sealing ring assembly of FIG. 5.

FIGS. 5-7 illustrate ring assembly 130 according to one or more embodiments. Ring assembly 130 defines an axis 131 and may include an outer metallic ring 132 with an inner circular resilient gasket 134. Ring 132 defines a convex outer circumferential surface 150 for sealing engagement with interior surface 120 of tubular member 119 (FIGS. 3A, 3B) and a concave inner circumferential surface 152. As best seen in FIG. 6, ring 132 may be characterized by a uniform axial cross-sectional profile having an outward-facing convexity 151 and an inward-facing concavity 153. In a relaxed state, ring 132 may have rounded V-shape profile. Gasket 134 has a convex outer circumferential surface 154 dimensioned to complement and fit within concave inner circumferential surface 152 (i.e., within concavity 153) of ring 132. The inner surface 156 of gasket 134 may be flat and dimensioned to seal against the reduced diameter region 103 of base 102 (FIGS. 3A, 3B). Ring 132 also defines an uphole end 160 and a downhole end 162 for engagement with uphole shoulder 110 and downhole shoulder 112 (FIGS. 3A, 3B), respectively.

According to one or more embodiments, ring 132 may include a first plurality of slits 170 radially formed through ring 132 about outer surface 150. Ring 132 may also include a second plurality of slits 172 formed through ring 132 about outer surface 150. Slits 172 may be circumferentially intervaled, or alternated, with slits 170. More particularly, the first plurality of slits 170 may be positioned toward uphole end 160 of ring 132, and the second plurality of slits 172 may be positioned toward downhole end 162 of ring 132. Even more particularly still, the first plurality of slits 170 may be positioned at least partially between convexity 151 and uphole end 160, and the second plurality of slits 172 may be positioned at least partially between convexity 151 and downhole end 162. Slits 170, 172 may extend beyond convexity 151.

Ring 132 may be made of steel, spring steel, titanium, or any other suitable metal. Gasket 134 may be made of an elastomeric material such as rubber, a polymer, or any other suitable gasket material. Ring 132 and gasket 134 may be separately formed, and gasket 134 may thereafter be inserted into inner surface 152 (i.e., concavity 153) of ring 132. Alternatively, gasket 134 may be directly molded into inner surface 152 (i.e., concavity 153) of ring 132. Slits 170, 172 may, but need not be, filled with a resilient material, such as rubber. The force generated during axial compression and radial expansion of gasket 134 during sealing operations may potentially fill Slits 170, 172 with gasket material.

Slits 170, 172 formed within metallic ring 132 enable diameter expansion (i.e., outer diameter fiber elongation) while minimizing stresses. In particular, because the widths of slits 170, 172 increase during radial expansion of ring 132, slits 170, 172 provide a scheme to reduce expansion stresses, thereby enabling the outer metallic fibers of ring 132 elongate without plastic deformation. Alternating slits 170 and 172 may reduce the tendency for gasket 134 material to extrude into slits 170, 172 during radial expansion.

Ring 132 may have any suitable unexpanded outer diameter for sealing against interior 120 of tubular member 119 (FIGS. 3A, 3B). In one or more embodiments, ring 132 may be arranged to provide an expanded outer diameter of approximately 0.05 inches to 1.0 inches greater than the unexpanded outer diameter. The number, positioning, and widths of slits 170, 172 may be selected to allow such outer diameter expansion without plastic deformation of metallic ring 132. In one or more embodiments, the width of slits 170, 172 may range between approximately 0.0001 inches to 0.1 inches.

To provide a numeric example, metallic ring 132 may have a retracted outer diameter of 3.45 inches and an expanded outer diameter of 3.70 inches. The circumference of ring 132 is 10.83 inches when unexpanded and 11.62 inches. when expanded. Thus, the outer fiber material length of ring 132 will increase by 0.79 inches during expansion. If first and second alternating pluralities of slits 170, 172 are provided, each with sixteen slits, there will be thirty-two slits in the outer most fibers. Accordingly, each slit width will increase at the outer fibers by 0.024 inches. If the widths of slits 170, 172 are 0.015 inches in the unexpanded state, in the expanded state the widths will be 0.039 inches.

In one or more embodiments, metallic ring 132 may provide a metal-to-metal seal against interior surface 120 of tubular member 119 (FIGS. 3A, 3B). In other embodiments, ring assembly 130 may include a thin resilient coating, such as rubber, (not expressly illustrated) formed over outer circumferential surface 150 for creating a metal-to-rubber interface with interior surface 120 of tubular member 119 (FIGS. 3A, 3B) to aid in sealing. Such a resilient coating may have a thickness of approximately 0.01 inches to 0.02 inches, although other thicknesses may also be used.

Figure 8:
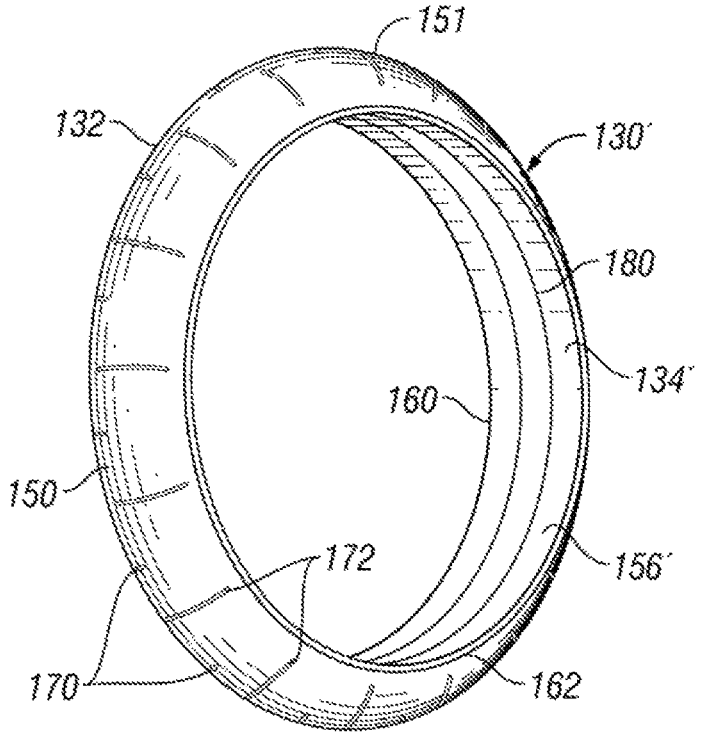
FIG. 8 is a perspective view of a sealing ring assembly according to an embodiment suitable for use in the sealing apparatus of FIG. 3A.
Figure 9A:
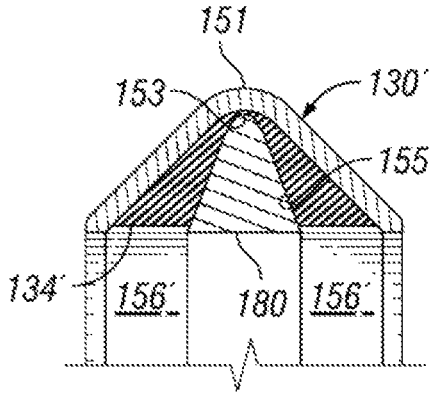
FIG. 9A is an axial cross section of a portion of the sealing ring assembly of FIG. 8, shown in a non-sealing state.
Figure 9B:
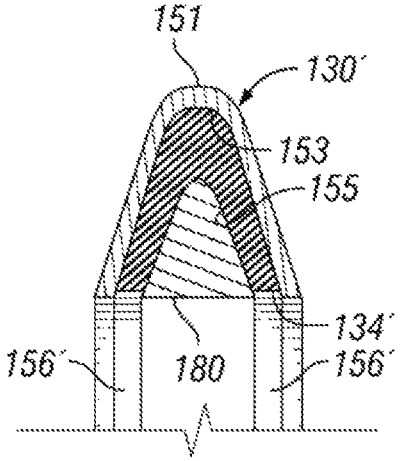
FIG. 9B is an axial cross section of a portion of the sealing ring assembly of FIG. 8, shown in a sealing state.

FIGS. 8-9B illustrate ring assembly 130' according to one or more embodiments. Like ring assembly 130 of FIGS. 5-7, ring assembly 130' may include an outer metallic ring 132 with an inner circular resilient gasket 134'. Ring assembly 130' also includes a circular stiffener 180. Ring 132 defines a convex outer circumferential surface 150 for sealing engagement with interior surface 120 of tubular member 119 (FIGS. 3A, 3B) and a concave inner circumferential surface 152. Ring 132 also defines an uphole end 160 and a downhole end 162 for engagement with uphole shoulder 110 and downhole shoulder 112 (FIGS. 3A, 3B), respectively.

As best seen in FIGS. 9A and 9B, ring 132 may be characterized by a uniform axial cross-sectional profile having an outward-facing convexity 151 and an inward-facing concavity 153. In a relaxed state, shown in FIG. 9A, ring 132 may have rounded V-shape profile. In an axially compressed radially expanded state, shown in FIG. 9B, ring 132 may have U-shape profile. Gasket 134 has a convex outer circumferential surface 154 dimensioned to complement and fit within concave inner circumferential surface 152 (i.e., within concavity 153) of ring 132. The inner surface of gasket 134 may have flat portions 156' dimensioned to seal against the reduced diameter region 103 of base 102 (FIGS. 3A, 3B). The inner surface of gasket 134 may also include an inner circumferential groove 155 into which stiffener 180 may be received.

Stiffener 180 may be made of steel, titanium, or a another suitable metal. Because stiffener replaces a volume of resilient gasket 134' with rigid material, stiffener 180 provides greater support of ring assembly 130' in the expanded diameter state. Stiffener 180 provides more structure and support, which aids in supporting gasket 134' and thereby enables sealing against higher pressure loads. Metal stiffener 180 also aids in supporting tensile loads created when a seal is formed and pressure is applied, may promote radial retraction of ring 132 and gasket 134' to original diameters, and may facilitate multiple reuse of ring 132 without redressing.

Figure 10:
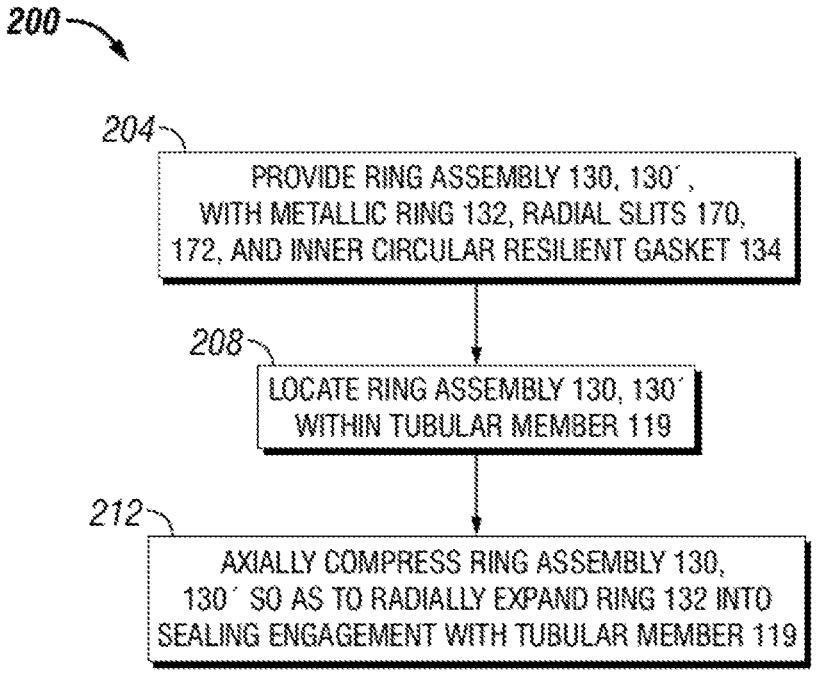
FIG. 10 is a flowchart of a method for sealing against an interior surface of a cylindrical tubular member, according to an embodiment.

FIG. 10 is a flowchart of a method 200 for sealing against an interior surface 120 of a cylindrical tubular member 119 (FIGS. 3A and 3B), according to an embodiment. Referring to FIGS. 5-7 and 10, at step 204, ring assembly 130, 130' is provided. Ring assembly 130, 130' may include ring 132, which may be characterized by a uniform axial cross-sectional profile with an outward-facing convexity 151, an inward-facing concavity 152, and a plurality of slits 170, 172 radially formed through ring 132 about an outer surface of the ring. A circular resilient gasket 134 is at least partially coaxially disposed within concavity 151. Ring assembly 130, 130' may be disposed within a tubular member at step 208. For instance, ring assembly 130, 130' may be run into a cased or lined wellbore. Finally, at step 212, ring assembly 130, 130' is axially compressed so as to radially expand ring 132 into sealing engagement with the interior surface of the tubular member.

As described hereinabove, sealing method 200 and sealing apparatus 100 with ring assembly 130, 130' allows for repeated sealing and unsealing operations under high differential pressures. Because ring 132 is metallic, sealing apparatus 100 is not prone to extrusion failure or nibbling. No extrusion limiter is required. Internal stresses within ring 132 are minimized by slits 170, 172, thereby preventing plastic deformation and enabling retraction and reuse.

In summary, an apparatus and method for sealing against an interior surface of a cylindrical tubular member have been described. Embodiments of an apparatus for sealing against an interior surface of a cylindrical tubular member may generally have: A metallic ring defining an axis, an uphole end, a downhole end, an inner circumferential surface, and an outer circumferential surface, the ring characterized by a uniform axial cross-sectional profile having an outward-facing convexity and an inward-facing concavity; a first plurality of slits radially formed through the ring about the outer surface; a circular resilient gasket at least partially coaxially disposed within the concavity; an uphole shoulder abutting the uphole end of the ring; and a downhole shoulder abutting the downhole end of the ring and axially movable with respect to the uphole shoulder so as to selectively axially compress and radially expand the ring. Embodiments of a method for sealing against an interior surface of a cylindrical tubular member may generally include: Providing an apparatus including a metallic ring characterized by a uniform axial cross-sectional profile with an outward-facing convexity and an inward-facing concavity, a first plurality of slits radially formed through the ring about an outer surface of the ring, and a circular resilient gasket at least partially coaxially disposed within the concavity; disposing the apparatus within the tubular member; and selectively axially compressing an uphole end of the ring with respect to a downhole end of the ring so as to radially expand the ring into sealing engagement with the interior surface of the tubular member.

Any of the foregoing embodiments may include any one of the following elements or characteristics, alone or in combination with each other: The first plurality of slits radially formed through the ring about the outer surface at least partially between the convexity and the uphole end; a second plurality of slits radially formed through the ring about the outer surface at least partially between the convexity and the downhole end; the second plurality of slits is circumferentially alternated between the first plurality of slits; a base coaxially disposed within the ring and forming one of the uphole shoulder and the downhole shoulder; a sleeve coaxially and axially movably carried by the base and forming the other of the uphole shoulder and the downhole shoulder; an actuator coupled between the uphole shoulder and the downhole shoulder; a circular stiffener at least partially coaxially disposed within the concavity, the resilient gasket sandwiched between the ring and the stiffener; the stiffener is characterized by a generally triangular axial cross-sectional profile; a resilient material filling the first plurality of slits; a resilient material filling the first and second pluralities of slits; a coating of resilient material formed about the outer surface; reducing stress within the ring during radial expansion of the ring by the first plurality of slits; radially forming the first plurality of slits through the ring about the outer surface at least partially between the convexity and the uphole end; radially forming a second plurality of slits through the ring about the outer surface at least partially between the convexity and the downhole end; circumferentially alternating the second plurality of slits between the first plurality of slits to reduce expansion of the circular gasket into the first and second pluralities of slits during radial expansion of the ring; coaxially carrying the ring about a base, the base forming one of an uphole shoulder disposed adjacent the uphole end of the ring and a downhole shoulder disposed adjacent the downhole end of the ring; coaxially carrying a sleeve about the base, the sleeve forming the other of the uphole shoulder and the downhole shoulder; selectively axially moving the sleeve with respect to the base to axially compress and radially expand the ring; selectively operating an actuator to axially compress and radially expand the ring; supporting the resilient gasket by a circular stiffener at least partially coaxially disposed within the concavity, the resilient gasket sandwiched between the ring and the stiffener; filling the first plurality of slits with a resilient material; coating the outer surface of the ring with a resilient material; and radially expand the ring to bring the resilient material into sealing engagement with the interior surface of the tubular member.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. An apparatus for sealing against an interior surface of a cylindrical tubular member, comprising:

a metallic ring defining an axis, an uphole end, a downhole end, an inner circumferential surface, and an outer circumferential surface, said ring characterized by an axial cross-sectional profile having an outward-facing convexity and an inward-facing concavity;

a first plurality of slits radially formed through said ring about said outer surface, each slit of said first plurality of slits having a pair of opposite axial ends defined between said convexity and said uphole end;

a second plurality of slits radially formed through said ring about said outer surface, each slit of said second plurality of slits having a pair of opposite axial ends defined between said convexity and said downhole end;

a circular resilient gasket at least partially coaxially disposed within said concavity;

an uphole shoulder abutting said uphole end of said ring; and a downhole shoulder abutting said downhole end of said ring and axially movable with respect to said uphole shoulder so as to selectively axially compress and radially expand said ring.

2. The apparatus of claim 1 further comprising:

a downhole end of said pair of opposite axial ends of said first plurality of slits defined axially within said convexity; and an uphole end of said pair of opposite axial ends of said second plurality of slits defined axially within said convexity.

3. The apparatus of claim 1 wherein:

said second plurality of slits is circumferentially alternated between said first plurality of slits.

4. The apparatus of claim 1 further comprising:

a base coaxially disposed within said ring and forming one of said uphole shoulder and said downhole shoulder; and a sleeve coaxially and axially movably carried by said base and forming the other of said uphole shoulder and said downhole shoulder.

5. The apparatus of claim 1 further comprising:

an actuator operably coupled to said uphole shoulder and said downhole shoulder to selectively control a distance between said uphole shoulder and said downhole shoulder.

6. The apparatus of claim 1 further comprising:

a circular stiffener at least partially coaxially disposed within said concavity, said resilient gasket sandwiched between said ring and said stiffener.

7. The apparatus of claim 6 wherein:

said stiffener is characterized by a generally triangular axial cross-sectional profile.

8. The apparatus of claim 1 further comprising:

a resilient material filling said first plurality of slits.

9. The apparatus of claim 2 further comprising:

a resilient material filling said first and second pluralities of slits.

10. The apparatus of claim 1 further comprising:

a coating of resilient material formed about said outer surface.

11. The apparatus of claim 2 wherein said axial cross-sectional profile is generally v-shaped defining a vertex, wherein said downhole end of said pair of opposite axial ends of said first plurality of slits is defined generally at said vertex, and wherein said uphole end of said pair of opposite axial ends of said second plurality of slits is defined generally at said vertex.

12. A method for sealing against an interior surface of a cylindrical tubular member, comprising:

providing an apparatus including a metallic ring characterized by axial cross-sectional profile with an outward-facing convexity and an inward-facing concavity, a first plurality of slits and a second plurality of slits radially formed through said ring about an outer surface of said ring, and a circular resilient gasket at least partially coaxially disposed within said concavity, wherein each slit of said first plurality of slits has a pair of opposite axial ends defined between said convexity and an uphole end of said ring and wherein each slit of said second plurality of slits has a pair of opposite axial ends defined between said convexity and a downhole end of said ring;

disposing said apparatus within said tubular member; and selectively axially compressing said apparatus such that said uphole end of said ring moves with respect to said downhole end of said ring so as to radially expand said ring into sealing engagement with said interior surface of said tubular member.

13. The method of claim 12 further comprising:

reducing stress within said ring during radial expansion of said ring by said first plurality of slits.

14. The method of claim 12 further comprising:

radially forming said first plurality of slits;

radially forming a second plurality of slits; and circumferentially alternating said second plurality of slits between said first plurality of slits to reduce expansion of said circular gasket into said first and second pluralities of slits during radial expansion of said ring.

15. The method of claim 12 further comprising:

coaxially carrying said ring about a base, said base forming one of an uphole shoulder disposed adjacent said uphole end of said ring and a downhole shoulder disposed adjacent said downhole end of said ring;

coaxially carrying a sleeve about said base, said sleeve forming the other of said uphole shoulder and said downhole shoulder; and selectively axially moving said sleeve with respect to said base to axially compress and radially expand said ring.

16. The method of claim 12 further comprising:

selectively operating an actuator to axially compress and radially expand said ring.

17. The method of claim 12 further comprising:

supporting said resilient gasket by a circular stiffener at least partially coaxially disposed within said concavity, said resilient gasket sandwiched between said ring and said stiffener.

18. The method of claim 12 further comprising:

filling said first plurality of slits with a resilient material.

19. The method of claim 12 further comprising:

coating said outer surface of said ring with a resilient material; and radially expand said ring to bring said resilient material into sealing engagement with said interior surface of said tubular member.

* * * * *